US005146700A

United States Patent [19]

Prosser

[11] Patent Number: 5,146,700

[45] Date of Patent: Sep. 15, 1992

[54] STEAM IRON WITH BONDED CERAMIC AND ALUMINUM COMPONENTS

[75] Inventor: Albert C. Prosser, Norman, Okla.

[73] Assignee: Coors Technical Ceramics Company, Norman, Okla.

[21] Appl. No.: 786,081

[22] Filed: Oct. 31, 1991

[51] Int. Cl.[5] ..... D06F 75/20; D06F 75/38

[52] U.S. Cl. ..... 38/77.9; 38/88; 38/93

[58] Field of Search ..... 38/74, 77.9, 80, 81, 38/88, 93, 94, 97, 82; 219/245, 254

[56] References Cited

U.S. PATENT DOCUMENTS

| | | | |
|---|---|---|---|
| 2,846,793 | 8/1958 | Studer | 38/93 X |
| 3,404,471 | 10/1968 | Wilsker et al. | 38/97 |
| 4,122,615 | 10/1978 | Baumgartner et al. | 38/93 |
| 4,774,395 | 9/1988 | Yabuuchi et al. | 38/82 X |
| 4,814,580 | 3/1989 | Carageorge | 219/245 X |
| 4,995,177 | 2/1991 | Louison et al. | 38/93 X |
| 5,014,454 | 5/1991 | Maurin et al. | 38/93 |

FOREIGN PATENT DOCUMENTS

| | | | |
|---|---|---|---|
| 2129100 | 6/1987 | Japan | 38/93 |
| 2225345 | 5/1990 | United Kingdom | 38/93 |

*Primary Examiner*—Werner H. Schroeder
*Assistant Examiner*—Ismael Izaguirre
*Attorney, Agent, or Firm*—Klaas, Law, O'Meara & Malkin

[57] ABSTRACT

An electrical steam iron having a housing for mounting of the components of the iron including an electrical heating element, a steam generating chamber, temperature controls, and a handle. A sole plate member made of ceramic material is mounted on the bottom of an aluminum connecting shoe portion of the housing by a resilient sealing and connecting material bonded between the connecting shoe portion and the sole plate member.

24 Claims, 3 Drawing Sheets

STEAM IRON WITH BONDED CERAMIC AND ALUMINUM COMPONENTS

BACKGROUND OF THE INVENTION

1. Field of the Invention

This invention relates to a portable household-type electrically heated steam iron for smoothing and pressing cloth goods or the like; and more particularly, to an electric steam iron having an aluminum upper heating and steam generating body member and a ceramic lower sole plate member.

2. Description of the Related Art

In general, an electric steam iron comprises a housing with a handle for holding the iron, a steam generating chamber, electrical heating elements for heating the iron and generating steam, electrical current control devices and supply cord device, and a sole plate having a flat boat-shape bottom surface with steam outlet passages for engaging the material to be ironed.

Most portable electric irons are heated by one or more electric resistance heaters including one or more wire-like resistors which can be connected in circuit with a source of electrical energy. The resistance heater elements can be installed in or above the sole plate portion of the iron.

In the past, conventional commercially-available sole plates have been made of metallic material, such as aluminum or steel. An advantage of aluminum is good heat conductivity and a relative low specific weight. However, the ability of an aluminum sole plate to resist scratching, scoring and similar damage is unsatisfactory. A sole plate which is made of steel is more resistant to wear; however, it is heavier and its thermal conductivity is less satisfactory than aluminum.

It has been suggested that a sole plate may be made from a main aluminum body portion or core which is electrically heatable and carries a thin-walled base plate of steel to contact the article to be ironed. If the iron is a steam iron, the sole plate must have openings for discharge of steam and the relatively thin base plate may undergo permanent deformation in the region of such openings which affects the quality of the ironing operation.

U.S. Pat. No. 4,835,363 discloses and electric steam iron heated by a halogen lamp and having a ceramic sole plate made from a ceramic material which transmits infrared light. U.S. Pat. Nos. 1,010,093; 2,179,890; 2,241,067 and U.S. Pat. No. 3,906,187 disclose electric irons having a glass sole plate.

U.S. Pat. Nos. 4,613,135, (vaporizer) 4,511,339, (steam cover and passage), U.S. Pat. No. 3,492,063 (nozzle) disclose steam iron apparatus including parts made of ceramic material. Ceramic material has also been used in other ironing apparatus such as an ironing board cloth underlay with a ceramic heating element (U.S. Pat. No. 4,452,931). U.S. Pat. No. 2,222,327 discloses an electric iron with a top housing 6 made of plastic material, a cast aluminum bottom presser plate 9 with a copper plate and a thin plate of isinglass therebetween. U.S. Pat. No. 3,098,922 discloses an electric infrared lamp heated iron having an aluminum sole plate 4. Cooking stove elements have been made of ceramic material as illustrated by U.S. Pat. Nos. 4,296,311 and 4,178,500.

SUMMARY OF THE INVENTION

An object of the invention is to provide an electric steam iron having a ceramic sole plate member providing improved heating and ironing characteristics.

Another object of the invention is to provide a new and improved steam iron with a ceramic sole plate member and a new and improved method of mounting of a ceramic sole plate on an aluminum shoe portion of an electric steam iron.

An additional object of the invention is to provide an electric iron having a ceramic sole plate wherein the heat transfer characteristics and ironing action of the sole plate is better than that of metallic sole plates of conventional, commercially-available irons.

Another object of the invention is to provide an electric iron with a ceramic sole plate which can be rapidly heated to a selected temperature and which will more easily, uniformly maintain a selected temperature.

Other objects of the invention are to eliminate corrosion and deterioration; provide equal uniform fast low heat transfer without scorching; enable easy cleaning without damage to the sole plate; and attachment of the ceramic sole plate by an epoxy material to an aluminum bottom surface of an upper body member of a conventional electric steam iron.

In general, the steam iron of the present invention comprises an upper mounting shoe portion made of aluminum material and a sole plate made of ceramic material connected to a steam chamber whose contents are heated by suitable electrically operated devices. Suitable passages are provided for admitting water into the steam chamber and for conveying steam from the chamber through the sole plate. The sole plate has a substantial number of steam outlet openings located in a predetermined distribution pattern. The sole plate is affixed to the aluminum shoe portion by novel and improved means and methods involving the use of a connecting and sealing means made of a rubber-like silicon material or the like. The general configuration and construction of the steam iron can be conventional with electric heating means connected to an outside source of electrical energy (e.g., a wall outlet) in a conventional manner. Suitable controls are provided on the housing, preferably in the region of the handle, to turn the heating means on or off as well as to select the desired temperature for the iron in actual use.

The present invention provides an electrical steam iron comprising a housing means for mounting of the components of the iron including an electrical heating element, a steam generating chamber, temperature controls, and a handle device. A connecting shoe portion made of aluminum material is mounted on the bottom of the housing means and has a plurality of upper steam transfer passages extending therethrough. A sole plate member made of ceramic material is mounted on the bottom of the connecting shoe portion. The sole plate member has a lowermost flat ceramic ironing surface and a plurality of lower steam outlet passages aligned with and connected to the upper steam transfer passages for applying steam to an article being ironed. Resilient sealing and connecting means are mounted between the connecting shoe portion and the sole plate member and are bonded to and between aluminum surface portions of the connecting shoe portion and ceramic surface portions of the sole plate member for permanently fixedly connecting the sole plate member to the connecting shoe portion in heat transfer relationship therewith. The sealing and connecting means are located in spaced surrounding sealing relationship to the steam passages and provide a peripheral seal between the connecting shoe portion and the sole plate member preventing lateral outward passage of steam therebetween while permitting downward passage of steam from the upper steam passages in the shoe portion to the lower steam passages in the sole plate member and downwardly through the lowermost flat ceramic ironing surface.

In a preferred embodiment, the ceramic sole plate has upwardly facing material holding channel means in a bottom wall portion for receiving a bonding and sealing material for permanently resiliently fixedly connecting the sole plate to the connecting shoe portion and for preventing lateral outward passage of steam from the steam passages. The upwardly facing material holding channel means has at least one continuous endless loop peripheral channel portion extending along and about the entire periphery of the sole plate adjacent a rim wall portion. A bonding and sealing means material is mounted in the material holding channel means in abutting bonding sealing engagement with ceramic bonding and sealing surfaces therewithin.

The connecting shoe portion comprises downwardly facing heat transfer surface portions located opposite and in heat transfer relationship with the upwardly facing heat transfer surface portions of the sole plate means; and downwardly facing bonding and sealing material engaging surface portions located opposite and in bonded sealing engagement with the bonding and sealing means material.

The present invention provides a method of manufacturing an electrically heating steam iron unit having an aluminum connecting shoe portion and a ceramic sole plate member permanently attached to the connecting shoe portion. The method comprises the steps of forming the connecting shoe portion from cast aluminum material with unmachined as-cast lowermost surface portions and a plurality of steam passages extending through the portions of the lowermost surface; forming the sole plate member from a fired ceramic material with a polished flat lowermost ironing surface and an upwardly facing mounting cavity corresponding in size and shape to the shoe connecting portion and having unfinished upwardly facing as-fired surface portions; providing channel portions between the lowermost surface portions and the upwardly facing surface portions; placing an uncured silicone compound material in the channel portions in the mounting cavity between and in abutting engagement with lowermost surface portions and the cavity bottom surface; placing the connecting shoe portion in the cavity with lowermost surface portions in abutting engagement with the uppermost surface portions and with the uncured silicon compound material; and curing the silicon compound material and causing the silicone compound material to be fixedly bonded to both the upwardly facing surface portions of the cavity and the downwardly facing surface portions of the connecting shoe portion with the steam passages located in open alignment with one another and in laterally spaced unblocked relationship to the silicon compound material.

BRIEF DESCRIPTIONS OF THE DRAWINGS

Illustrative and presently preferred embodiments of the invention are shown in the accompanying drawings in which.

DESCRIPTION OF THE PREFERRED EMBODIMENTS

Figure 1:
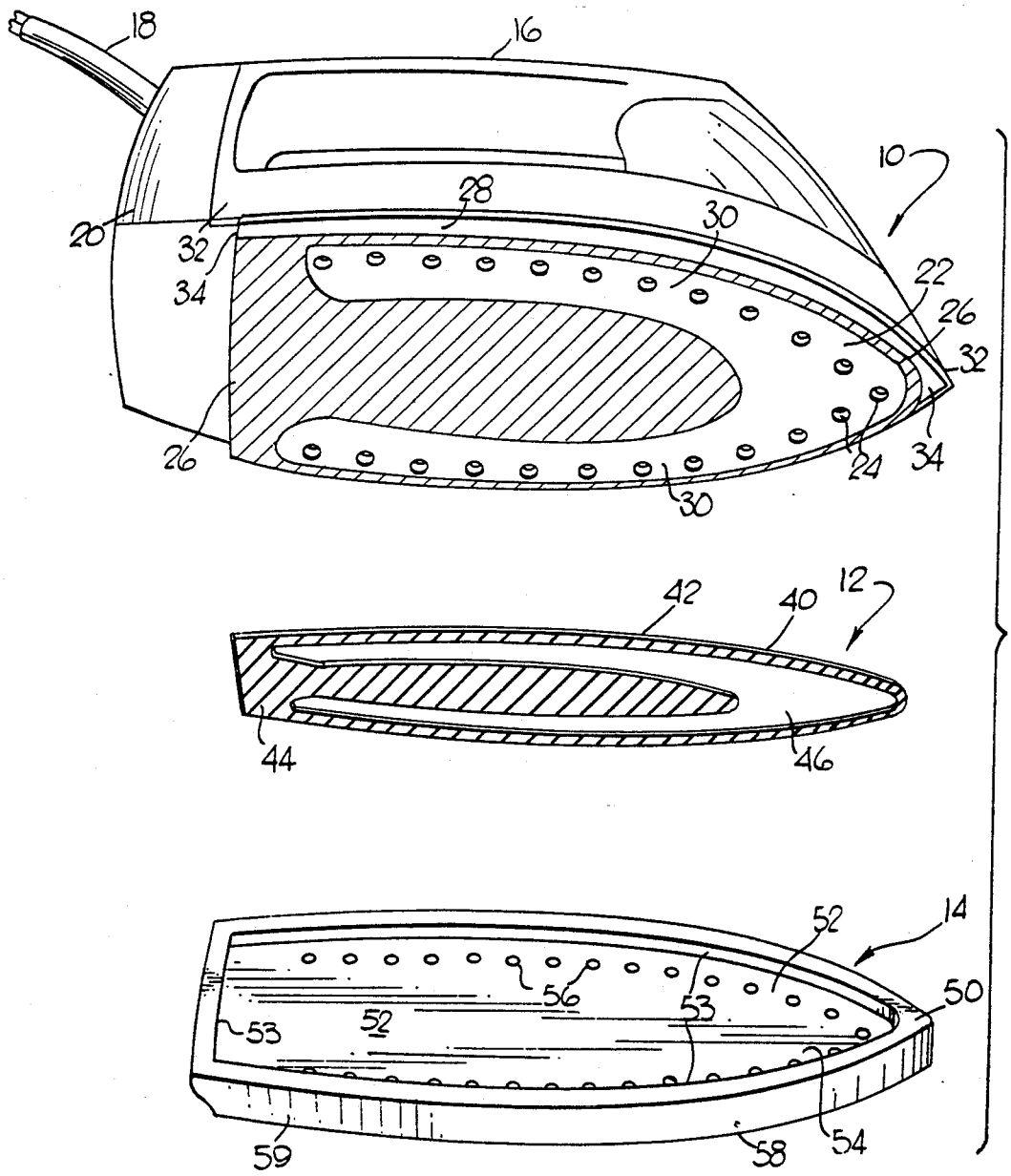
FIG. 1 is an exploded perspective view of an electric , steam iron.
Figure 2:
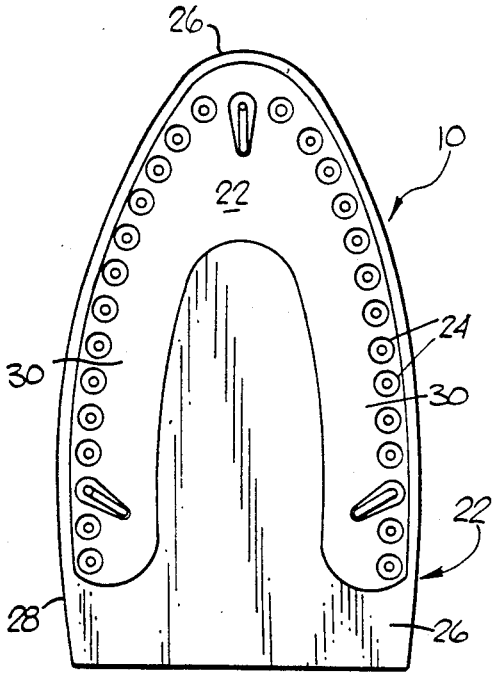
FIG. 2 is a bottom view of the upper aluminum shoe portion of the steam iron.
Figure 3:
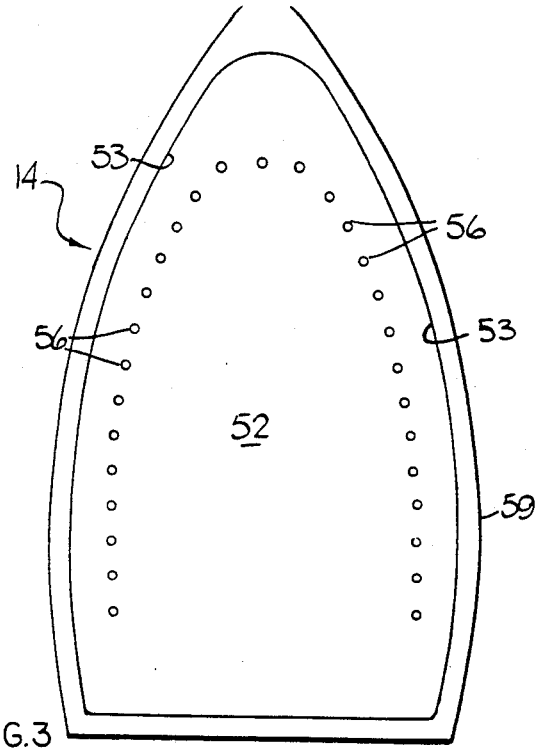
FIG. 3 is a top view of the ceramic sole plate.

As shown in FIG. 1, in general, the electric steam iron unit of the present invention comprises a conventional upper housing means portion 10, an intermediate rubber-like sealing and connecting means portion 12, and a lower ceramic sole plate means member 14. The upper housing means portion is of generally conventional construction and design and comprises a handle means 16, an electrical cord means 18, an electrical control input means 20, a water supply means (not shown), electrical heating means (not shown) and a steam generating chamber means (not shown). A lowermost connecting shoe means 22 is made of aluminum material and is in heat transfer relationship with the electrical heating means. The shoe means is provided with a plurality of steam outlet passage means 24 connected to the steam generating chamber. Shoe means 22 has a first uppermost flat bottom surface portion 26 which intersects and extends transversely to a continuous downwardly extending outer peripheral side surface portion 28, and a second lowermost, generally U-shape flat bottom surface portion 30 which is downwardly offset relative to uppermost bottom surface 26 and laterally inwardly offset relative to side wall portion 28. Offset surface 30 provides a generally U-shape abutment shelf means in which the steam passages 24 are located. An outer skirt means 32 extends downwardly from the housing means in laterally outwardly spaced relationship to shoe side wall portion 28 to provide a peripheral slot means 34 therebetween.

In the embodiment of FIGS. 1–4, the sealing and connecting means 12 is made from conventional uncured sheet-type silicone rubber material having a peripheral side surface 40, a flat upper surface 42, and a flat lower surface 44 corresponding to the size and shape of aluminum flat bottom surface 26. A cutout portion 46 corresponds in size and shape to downwardly offset lowermost surface portion 30. The sealing and connecting means material may be made from any suitable conventional, high-temperature resistance material such as a relatively thin (e.g. 0.010 to 0.020 inch) die cut sheet of uncured silicone material, a silicon epoxy pad, silicon gel, polyfoam silicon or a silicon tape. The sealing and connecting means material may preferably be a high temperature resistant silicon such as RTV Super Silicon paste material manufactured by 3M Company as hereinafter described in connection with FIGS. 5-9. The sealing and connecting material has sufficient bonding properties to form a permanent connecting bond between the adjacent aluminum and ceramic surfaces and provides a permanent high-temperature resistant shock resistant bonding and sealing therebetween. The material may be self-curing at elevated temperatures or at ambient temperatures. The material may be used on as-cast metallic surfaces and on as-fired ceramic surfaces without finishing (i.e. upolished and uncut) of those surfaces. The elongational characteristics (elasticity) of the material is sufficient to allow for the high rate o expansion of the aluminum material and the low rate of expansion of the ceramic material so as to maintain the integrity of the bond and the seal.

The ceramic sole plate member 14 comprises a continuous outer boat-shape peripheral rim portion 50 which surrounds a mounting cavity 52 having an inner side wall surface portion 53 which generally corresponds in size and shape to side wall portion 28 of connecting shoe portion 22. Cavity 52 has a flat bottom wall portion 54 having a plurality of steam passages 56 generally corresponding in size and shape to connecting shoe portion 22 and steam passages 24. Sole plate member 14 has a highly polished flat bottom ironing surface 58 and peripheral outer side wall surface 59 generally corresponding to the size and shape of the housing skirt portion 32. The side and shape of cavity 52 corresponds to the size and shape of shoe portion 22, so that the shoe portion 22 fits closely within the mounting cavity 52 with steam passages 24 in alignment with steam passages 56 which may have enlarged conical outlet end portions 60 in bottom ironing surface 58.

The ceramic may be of aluminum oxide, zirconium, oxide, silicon carbide, tungsten carbide, silicon nitride, tungsten nitride, but is not limited to these ceramic materials. Aluminum oxide is preferred as it may be polished to a two micro inch surface finish providing an excellent ironing surface. Aluminum oxide has a thermal expansion coefficient of $3.3\times10$ to the minus sixth power inches per inch per degree F. Aluminum oxide is one of the hardest of all man-made materials, listed next to diamond on the Mohs scale. This hardness provides excellent abrasion resistance and dimensional stability for years of life.

In assembly, silicon sealing and connecting member 12 is placed in cavity 52 in abutting engagement with portions of the upper surface of the ceramic sole plate member 14. The aluminum shoe portion 22 of the steam iron is placed in cavity 52 with surface 26 on top of and in abutting engagement with the upper surface 42 of the silicon member 12. The lowermost shelf portion 30 of the shoe is located in slot 46 in member 12 with the lowermost aluminum heat transfer surface thereof located opposite corresponding portions of the upwardly facing ceramic surface 54 of the cavity 52 and with the steam passages 24 and 56 in alignment. Then, heat is applied to the sealing and connecting member 12 whereby the ceramic sole plate member 14 is fixedly secured to the main aluminum body portion of the steam iron during curing of the member 12 while also providing a continuous sealing layer therebetween in laterally spaced relationship to the steam passages. Thus, an adhesive sealing laminate layer of material is bonded to and permanently fixed between the sole plate member and the main body portion. Protective skirt 30 is laterally spaced from and extends along the outer side surface 59 of the sole plate member.

Figure 8:
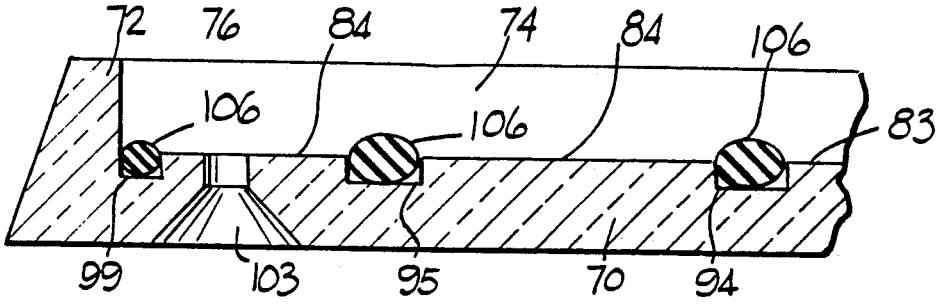
FIG. 8 is an enlarged cross-sectional view of another portion of the ceramic sole plate of FIGS. 5 and 6 with uncured silicon material in the sealant retaining channels.
Figure 9:
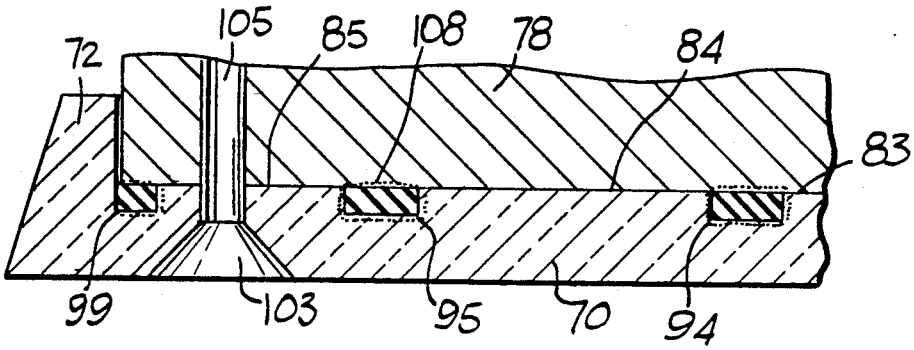
FIG. 9 is an enlarged cross-sectional view of a portion of the ceramic sole plate of FIG. 8 after assembly with an aluminum shoe portion of the iron housing.

FIGS. 5-9 show a presently preferred embodiment of the invention having a ceramic sole plate member 70 with a peripheral rim portion 72 surrounding a shoe mounting cavity 74 having an inner side wall surface portion 76 generally corresponding in size and shape to the periphery of an aluminum connecting shoe means 78, FIG. 9, as previously described.

Figure 5:
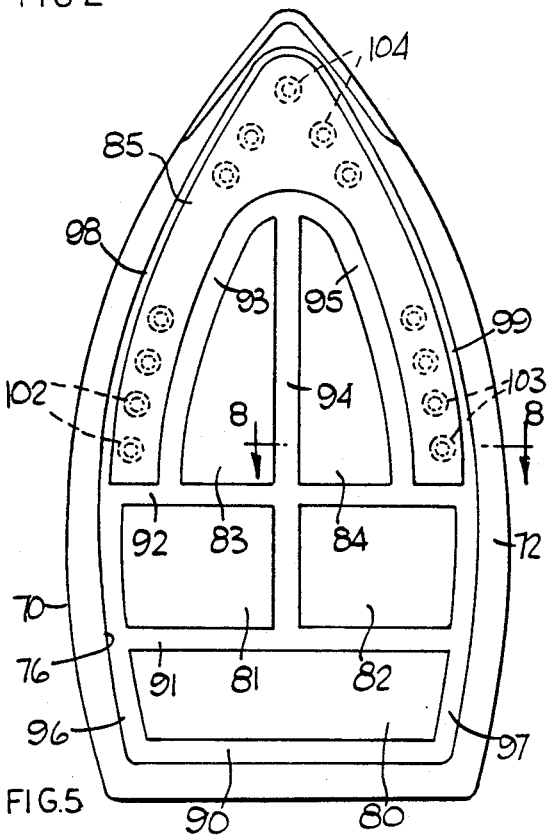
FIG. 5 is a plan view of a presently preferred embodiment of a ceramic sole plate.
Figure 4:
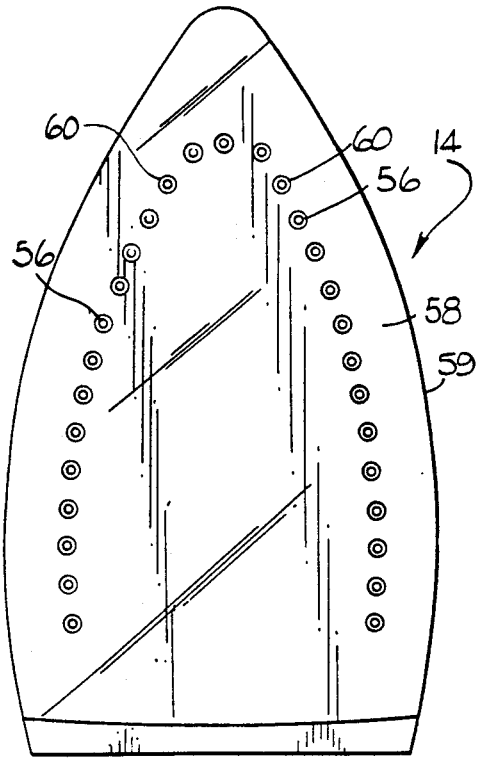
FIG. 4 is a bottom view of the ceramic sole plate.
Figure 6:
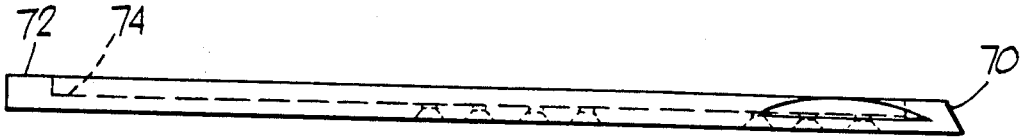
FIG. 6 is a side elevational view of the ceramic sole plate of FIG. 5.
Figure 7:
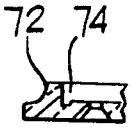
FIG. 7 is a cross-sectional view of a portion of the ceramic sole plate of FIGS. 5 and 6.

Sole plate member 70 has a plurality of upwardly facing flat heat transfer surface portions 80, 81, 82, 83, 84, 85, FIG. 5, surrounded by continuous interconnected sealing and connecting channel means 90, 91, 92, 93, 94, 95, 96, 97, 98, 99. A plurality of steam passages 102, 103, 104, are provided in U-shape surface portion 85 and are arranged in a suitable pattern corresponding to steam passages 105, FIG. 9, in the connecting shoe portion 78 as previously described.

The connecting and sealing means is formed from a continuous bead of paste-like silicon material 106 which is placed in the channel means during assembly as shown in FIG. 8 and is subsequently cured to provide a permanent connecting and sealing band of material 108, as shown in FIG. 9.

In assembly, FIGS. 8 and 9, a continuous bead of a commercially-available, uncured, silicon paste material 106 is placed in the sealant retaining channels 90-99 of the ceramic sole plate 70. The paste material is applied by a suitable applicator device (not shown) having an outlet nozzle which forms a continuous bead of material having a generally circular cross-sectional configuration with a diameter greater than the depth of the sealant retaining channels so that an upper portion of the sealant bead extends above the adjacent upper flat surfaces of the sole plate mounting cavity 74. The aluminum shoe portion 78 of the steam iron is located within the ceramic plate cavity 74 with steam passages 105 corresponding to and aligned with the steam outlet passages 103 in the ceramic sole plate member 70. Downwardly facing flat heat transfer abutment surfaces 110 on the aluminum shoe portion correspond to and are aligned with and located in abutting engagement with the upwardly facing flat heat transfer surfaces 80-85 on the ceramic sole plate. The uncured connecting and sealing silicon material is forced into the retaining channels 90-99 and into intimate abutting engagement with the ceramic and aluminum surfaces thereabout. As the silicon material cures, the ceramic sole plate member 70 is permanently fixedly attached to the aluminum shoe portion 78 of the housing and a continuous seal 112 is formed around the periphery of the sole plate and the surface 85 having the aligned steam passages. The silicon paste material may be cured at ambient temperatures. After curing the silicon, the silicon material provides an elastic, non-breakable, high temperature-resistant, highly adherent connecting and sealing means.

While illustrative and presently preferred embodiments of the invention have been described, it is intended that the appended claims be construed to include alternative embodiments except insofar as limited by the prior art.

What is claimed is:

1. An electrical steam iron having:

a housing means for housing components of the iron including an electrical heating element, a steam generating chamber, temperature controls, a handle, and comprising a connecting shoe portion made of aluminum material mounted on the bottom of said housing means and having a plurality of upper steam transfer passages extending therethrough;

a sole plate member made of ceramic material mounted on the bottom of said connecting shoe portion and having a lowermost flat ceramic ironing surface and a plurality of lower steam outlet passages aligned and in fluid communication with said upper steam transfer passages for applying steam to an article being ironed; and resilient sealing and connecting means mounted between said connecting shoe portion and said sole plate member and being bonded to and between aluminum surface portions of said connecting shoe portion and ceramic surface portions of said sole plate member and being located in spaced surrounding sealing relationship to said steam passages for permanently fixedly connecting said sole plate member to said connecting shoe portion in heat transfer relationship therewith and providing a peripheral seal between said connecting shoe portion and said sole plate member preventing lateral outward passage of steam therebetween while permitting downward passage of steam from the upper steam passages in said shoe portion to the lower steam passages in said sole plate member and downwardly through said lowermost flat ceramic ironing surface.

2. The steam iron as defined in claim 1, and further comprising:

channel means between said connecting shoe portion of said housing means and said ceramic sole plate member for receiving and holding said connecting and sealing means.

3. The steam iron as defined in claim 1, and said connecting shoe portion having at least one flat downwardly facing abutment surface and said sole plate member having at least one flat upwardly facing abutment surface located opposite said downwardly facing abutment surface on said shoe portion in heat transfer relationship therewith;

said steam passages communicating through said downwardly facing abutment surface and said upwardly facing abutment surface;

connecting and sealing holding channel means located between said connecting shoe portion and said sole plate member and having oppositely facing spaced continuous aligned surfaces in abutting connecting and sealing relationship with corresponding oppositely facing spaced continuous aligned surfaces of said connecting and sealing means.

4. The steam iron as defined in claim 3, and wherein:

said channel means have a U-shape cross-sectional configuration.

5. The steam iron as defined in claim 4, and said channel means being formed in said sole plate member.

6. The steam iron as defined in claim 5, and said channel means being formed by opposed spaced flat horizontal surfaces of said connecting shoe portion and said sole plate member and a vertical surface extending therebetween.

7. The steam iron as defined in claims 1 or 3, and wherein: silicon compound material which is cured after assembly

8. The steam iron as defined in claim 7, and wherein the silicon compound material is a sheet of material.

9. The steam iron as defined in claim 7, and wherein the silicon compound material is a paste material.

10. The steam iron as defined in claim 7, and said connecting shoe portion being mounted in a mounting cavity in said sole plate member of corresponding size and shape.

11. The steam iron as defined in claim 1, and said connecting shoe portion comprising:

flat horizontal lowermost downwardly facing heat transfer surface means for transferring heat from said electrical heating means to said sole plate member;

said sole plate member comprising:

a vertical peripheral rim wall portion connected to and extending upwardly from a periphery of a bottom wall portion;

a plurality of horizontal flat upwardly facing heat transfer surface means on said bottom wall portion for receiving heat from said, lowermost downwardly facing heat transfer surface means of said connecting shoe portion; and channel means between said sole plate member and said connecting shoe portion for receiving said connecting and sealing means and being located in laterally spaced relationship to said heat transfer surface means having heat transfer therebetween and being located in laterally spaced relationship to and between said steam passages and said rim portion for passage of steam through said lowermost ironing surface while preventing passage of steam along the periphery of said sole plate member.

12. An electrical steam ironing device having electrical heating apparatus and steam generating apparatus and comprising:

a sole plate means made of ceramic material for providing an ironing surface for engaging an article to be ironed; and connecting shoe means made of aluminum material for mounting of said sole plate means and for transfer of heat and steam to said sole plate means;

said ceramic sole plate means comprising:

a bottom wall portion having a flat polished downwardly facing lowermost ironing surface and upwardly facing heat transfer surface portions;

a rim wall portion located on an outer periphery of said bottom wall portion;

a plurality of steam outlet passages in said bottom wall portion and extending through said upwardly facing heat transfer surface portions and extending through said lowermost ironing surface and being laterally inwardly spaced relative to said rim wall portion;

upwardly facing sealing and bonding material holding channel means in said bottom wall portion for receiving and holding a bonding and sealing material for permanently resiliently fixedly connecting said sole plate means to said connecting shoe means and for preventing lateral outward passage of steam from said steam passages along the periphery of said rim wall portion;

said upwardly facing sealing and bonding material holding channel means having ceramic bonding and sealing surfaces provided by said sole plate means and having at least one continuous endless loop peripheral channel portion extending along and about the entire periphery of said sole plate means adjacent said rim wall portion;

bonding and sealing material mounted in said material holding channel means and having at least one continuous uninterrupted endless loop of material in said one continuous endless loop peripheral channel portion of said material holding channel means and being in abutting bonding sealing engagement with said ceramic bonding and sealing surfaces therewithin;

said connecting shoe means comprising:

downwardly facing heat transfer surface portions located opposite and in heat transfer relationship with said upwardly facing heat transfer surface portions of said sole plate means; and downwardly facing bonding and sealing material engaging surface portions of said connecting shoe means being located opposite to and in bonded sealing engagement with said bonding and sealing material.

13. The ironing device as defined in claim 12, and said rim wall portion further comprising an upwardly extending rim wall portion extending upwardly from the bottom wall portion and defining an upwardly facing cavity above said bottom wall portion; and said connecting shoe means being mounted in said cavity.

14. The ironing device as defined in claim 13, and said one continuous endless uninterrupted peripheral channel portion being located laterally inwardly adjacent said upwardly extending rim wall portion.

15. The ironing device as defined in claim 12, and said sole plate means comprising a sole plate member made of one piece of ceramic material.

16. The ironing device as defined in claim 15, and said sole plate member having unpolished as-fired upwardly facing heat transfer surfaces and channel surfaces.

17. A method of manufacturing an electrically heated steam iron which comprises an aluminum connecting shoe portion and a ceramic sole plate member permanently attached to the connecting shoe portion, the method comprising:

forming the connecting shoe portion from cast aluminum material with unmachined as-cast lowermost surface portions and a plurality of steam passages extending through portions of the lowermost surface;

forming the sole plate member from a fired ceramic material having steam passages therethrough and with a polished flat lowermost ironing surface and an upwardly facing mounting cavity corresponding in size and shape to the shoe connecting portion and having unfinished upwardly facing as-fired surface portions;

providing channel portions between the portions of said lowermost surface portions and the upwardly facing surface portions;

placing an uncured silicone compound material in said channel portions in said mounting cavity between and in abutting engagement with said portion of the lowermost surface portions and said cavity upwardly facing surface;

placing the connecting shoe portion in the cavity with the lowermost surface portions in abutting engagement with the uppermost surface portions and with the uncured silicon compound material; and curing the silicon compound material and causing the silicon compound material to be fixedly bonded to both the upwardly facing surface portions of the cavity and the downwardly facing surface portions of the connecting shoe portion with the steam passages located in open alignment with one another and in laterally spaced unblocked relationship to the silicon compound material.

18. The method of manufacture as defined in claim 17 further comprising:

in the silicone material placing step, placing a continuous bead of uncured paste-like silicon compound material in the channel portions with a portion of the bead of material located beyond the adjacent flat abutment surface portions;

in the step of placing the connecting shoe portion in the cavity placing the sole plate member and the shoe portion of the housing in peripherally aligned juxtaposition to one another with the abutment surface portions in abutting supportive engagement with one another and simultaneously compressing said uncured bead of silicon material into said channel portions and into intimate continuous abutting engagement with said oppositely facing aligned connecting surface portions; and in said curing step, curing said uncured bead of silicon material to form a solid continuous dry elastic band of material having opposite facing surfaces integrally permanently bonded to and between aluminum surfaces on said shoe portion and ceramic surfaces on said sole plate member.

19. The method as defined in claim 18, and wherein the silicone compound material is cured by application of heat.

20. The method as defined in claim 19, and wherein the silicone compound material is cured at ambient temperatures.

21. The method as defined in claim 20, and wherein the silicone compound material is a sheet of uncured silicon material cut to fit around the contour of the abutting surfaces between the shoe portions and the plate member.

22. The method as defined in claim 21, and wherein:

the portions of the sole plate member other than the ironing surface is made from as-cast and fired unpolished and uncut ceramic material.

23. The method as defined in claim 22, and wherein:

the aluminum shoe portion is made from cast and unpolished aluminum material.

24. The method as defined in claim 17, and wherein the silicone material is made from a performed sheet of uncured silicone material which is die cut to a required size and shape.

* * * * *

UNITED STATES PATENT AND TRADEMARK OFFICE

CERTIFICATE OF CORRECTION

PATENT NO. : 5,146,700

DATED : September 15, 1992

INVENTOR(S) : ALBERT C. PROSSER

It is certified that error appears in the above-identified patent and that said Letters Patent is hereby corrected as shown below:

Col. 4, line 2, delete "," before "steam".

Col. 5, line 12, "rate o" should read --rate of--.

In the Claims:

Claim 1, Column 6, line 66, "comprising" should read —comprising:--

Claim 7, Column 7, line 63, after "wherein" and before "silicon", insert the words --said connecting and sealing means is made from uncured—.

Claim 11, Column 8, lines 8 and 9, delete "from said electrical heating means".

Claim 18, Column 10, line 22, after "cavity" insert a comma --,--; and line 30, delete "connecting".

Claim 21, Column 10, line 46, "portions" should read —portion--.

Signed and Sealed this

Fifth Day of October, 1993

Bruce Lehman

*Attest:*

BRUCE LEHMAN

*Attesting Officer*

*Commissioner of Patents and Trademarks*